US007567088B2

(12) United States Patent
Yoshida et al.

(10) Patent No.: US 7,567,088 B2
(45) Date of Patent: Jul. 28, 2009

(54) FOREIGN OBJECT DETECTION APPARATUS

(75) Inventors: Kazushi Yoshida, Kasumigaura (JP); Tadashi Osaka, Kashiwa (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 168 days.

(21) Appl. No.: 11/834,721

(22) Filed: Aug. 7, 2007

(65) Prior Publication Data

US 2008/0035446 A1 Feb. 14, 2008

(30) Foreign Application Priority Data

Aug. 8, 2006 (JP) ..... 2006-215727

(51) Int. Cl.
*G01R 27/04* (2006.01)
*G07D 11/00* (2006.01)
*G07D 5/08* (2006.01)

(52) U.S. Cl. ..... 324/663; 324/671; 235/379; 194/317

(58) Field of Classification Search ..... 324/663, 324/671, 665
See application file for complete search history.

(56) References Cited

U.S. PATENT DOCUMENTS 4,536,709 A * 8/1985 Ishida ..... 324/239
5,087,027 A * 2/1992 Acquaviva ..... 271/258.04
5,394,969 A * 3/1995 Harbaugh ..... 194/206
5,687,829 A * 11/1997 Churchman ..... 194/317
6,907,977 B1 * 6/2005 Barchuk ..... 194/317
7,012,567 B2 3/2006 Osaka et al.
7,055,738 B2 * 6/2006 Landwehr et al. ..... 235/379
2003/0080755 A1 5/2003 Kobayashi
2004/0129771 A1 7/2004 Landwehr et al.
2007/0062753 A1 3/2007 Yoshida et al.

FOREIGN PATENT DOCUMENTS

JP 1-230190 9/1989
JP 2001-084426 3/2001
JP 2003-202383 7/2003
WO WO 00/46760 8/2000

* cited by examiner

*Primary Examiner*—Vincent Q Nguyen
*Assistant Examiner*—Jeff Natalini
(74) *Attorney, Agent, or Firm*—Antonelli, Terry, Stout & Kraus, LLP.

(57) ABSTRACT

A foreign object detection apparatus has at least one pair of first and second members which are members configuring a space, in which bills to be processed are deposited, and disposed to face each other to push and sandwich the bills therebetween, the first member provided with antennas made of a copper foil and applied with a voltage from a voltage applying unit and the second member made of a conductive material and grounded to configure a virtual capacitor; a measuring unit which is disposed to measure a voltage generated according to electrostatic capacitance of the virtual capacitor; and a judging unit which judges the presence or not of a foreign object according to a difference between a prescribed reference signal and a changed output voltage from the measuring unit depending on a change in electrostatic capacitance of the virtual capacitor due to the foreign object included in the bills.

6 Claims, 8 Drawing Sheets

FOREIGN OBJECT DETECTION APPARATUS

BACKGROUND OF THE INVENTION

The present invention relates to an apparatus for detecting a foreign object in a bill processing device, and more particularly to an apparatus for detecting a foreign object which is deposited together with bills into a bill deposit/withdrawal port of an automated teller machine.

An apparatus, such as a bill deposit/withdrawal processing apparatus, a deposit-only apparatus or the like, which processes bills in accordance with a deposit operation performed by a user has a trouble if a foreign object such as a coin, a paper clip or the like is mistakenly included in the deposit port in which bills are deposited, and the included foreign object is taken into the apparatus together with the bills, resulting in causing a jam of bills or a failure of the apparatus.

The device for detecting metallic piece remaining disclosed in JP-A-2001-84426 has a coil for detecting a magnetic change to detect the presence or not of a coin by utilizing a change in quantity of magnetic flux which crosses the coil depending on the presence or not of a coin.

The proximity sensor and object detecting device disclosed in JP-A-2003-202383 has a detection electrode in an object detecting region to detect an object to be detected by detecting a change in electrostatic capacitance between the detection electrode and the object present in the object detecting region.

SUMMARY OF THE INVENTION

Since the device for detecting metallic piece remaining disclosed in JP-A-2001-84426 detects a foreign substance depending on a magnetic change of the coil, it has a drawback that it cannot detect a non-magnetic foreign substance such as a dust ball, a bit of paper or the like. In addition, it has a structural drawback in securing the detection performance because even when the foreign substance is a magnetic substance, it is necessary to approach the foreign substance close enough to the coil in order to detect the foreign substance.

The proximity sensor and object detecting device disclosed in JP-A-2003-202383 can detect not only a magnetic foreign substance but also a non-magnetic foreign substance. But, since stray capacitance (between, for example, the detection electrode and its circumferential ground) causes false detection, highly accurate detection cannot be expected. In addition, when measures against the stray capacitance are taken, there is a problem that the structure becomes complex.

The present invention provides an apparatus for detecting quickly an included foreign object in order to prevent a trouble such as a jam of bills or a failure of equipment due to the foreign object included in the bill deposit/withdrawal port of a bill processing section or the like of an automated teller machine, a bill processing device or another machine that a user is required to perform a deposit operation.

The present invention has been made in view of the above circumstances and provides a foreign object detection apparatus, comprising at least one pair of first and second members which are members configuring a space, in which bills to be processed are deposited, and disposed to face each other to push and sandwich the bills therebetween; a first electrode member which is made of a conductive material disposed on at least a part of the first member to face the space; a second electrode member which is made of a conductive material disposed on at least a part of the second member to face the space; a ground unit which grounds the second electrode member; a voltage applying unit which applies a voltage to the first electrode member; a measuring unit which measures a voltage generated according to electrostatic capacitance of a virtual capacitor which is comprised of the first and second electrode members; and a judging unit which judges whether a foreign object is present according to a difference between a prescribed reference signal and a changed output voltage from the measuring unit depending on a change in electrostatic capacitance of the virtual capacitor.

The foreign object detection apparatus according to the invention comprises at least one pair of first and second members which are members configuring a space, in which bills to be processed are deposited, and disposed to face each other to push and sandwich the bills therebetween; a first electrode member which is made of a conductive material disposed on at least a part of the first and second members to face the space; a second electrode member which is made of a conductive material disposed on at least a part of the first and second members to face the space; a ground unit which grounds the second electrode member; a voltage applying unit which applies a voltage to the first electrode member; a measuring unit which measures a voltage generated according to electrostatic capacitance of a virtual capacitor which is comprised of the first and second electrode members; and a judging unit which judges whether a foreign object is present according to a difference between a prescribed reference signal and a changed output voltage from the measuring unit depending on a change in electrostatic capacitance of the virtual capacitor.

The foreign object detection apparatus according to the invention also has a distance calculation unit which calculates a distance between the first member and the second member and a storage unit which stores a distance determined by the distance calculation unit and a voltage detected by the measuring unit in correspondence with the distance and determines as a reference signal.

The foreign object detection apparatus according to the invention also has an oscillation circuit which generates a high-frequency sine wave in the voltage applying unit.

In addition, the foreign object detection apparatus of the invention is for a bill processing device, and the space in which the bills to be processed are deposited is a space of the bill processing device in which bills are deposited.

By configuring as described above, the present invention can detect the presence of a foreign object with high precision prior to the start of bill feeding operation even when a bill processing section or the like of an automated teller machine, a bill processing device or another apparatus has a foreign object such as a coin, a paper clip or the like included together with bills within the bill deposit/withdrawal port. As a result, measures such as stopping of the bill processing operation, issuing of an alarm to the user to request the removal of a foreign object or the like can be taken, thereby producing effects such as provision of the apparatus with high reliability by preventing a problem such as a jam of bills, a damage or failure of the apparatus from being caused by the foreign object.

Other objects, features and advantages of the invention will become apparent from the following description of the embodiments of the invention taken in conjunction with the accompanying drawings.

DESCRIPTION OF THE EMBODIMENTS

Embodiments of the present invention will be described with reference to the accompanying drawings.

EXAMPLE 1

Figure 1:
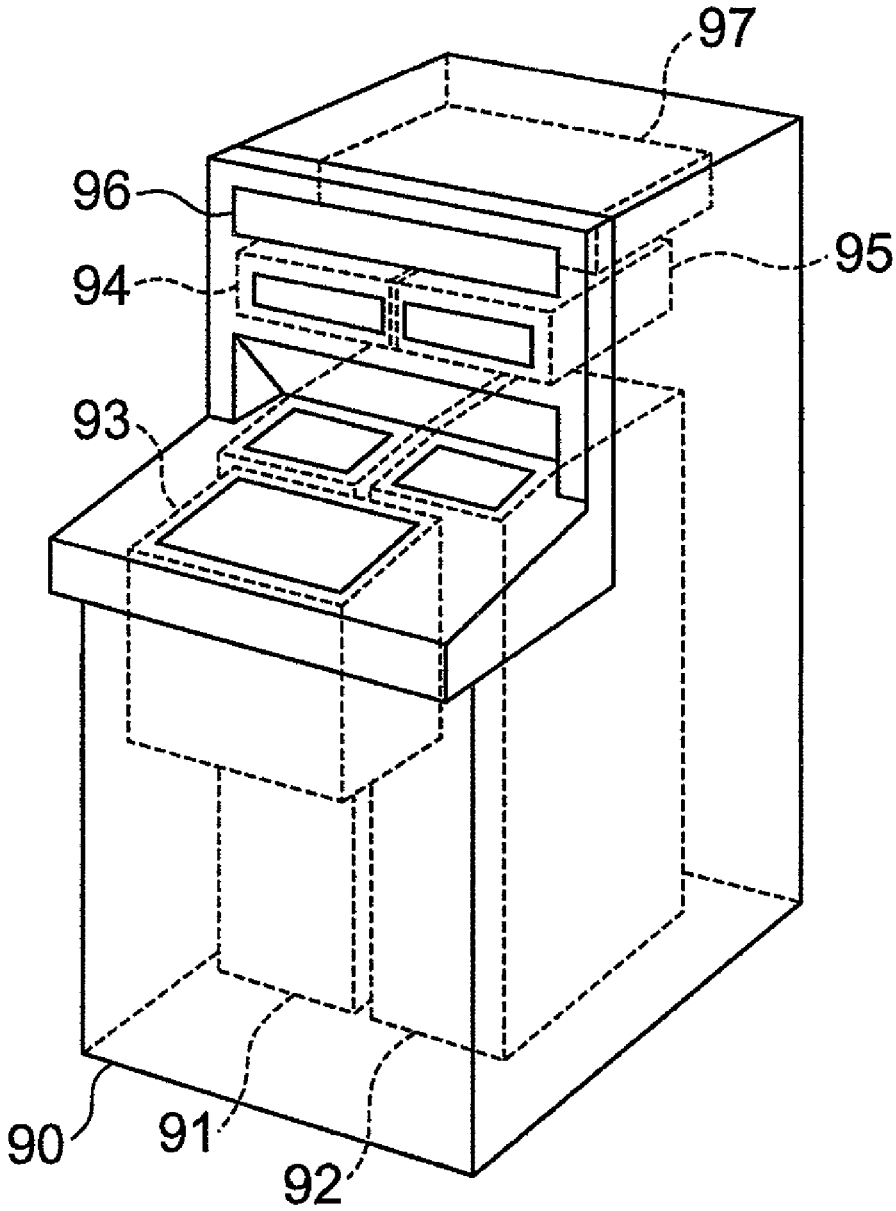
FIG. 1 shows an automated teller machine, which is installed in branches of financial institutions, according to an embodiment of the invention.

FIG. 1 is an example of an automated teller machine which is installed in branches of financial institutions to which the present invention is applied. As shown in FIG. 1, an automated teller machine 90 has a bill handling unit 91 for processing bills, a coin handling unit 92 for processing coins, a display operation section 93 for displaying operation guides and transaction items for a user and for inputting information required for transaction by the user, a passbook handling unit 94 for passbook update processing, a card slip handling unit 95 for reading information on a cash card which is a transaction medium of the user, issuing an account statement and the like, a guide display section 96 for displaying the transaction items, and a control section 97 for controlling the individual transaction units.

Figure 2:
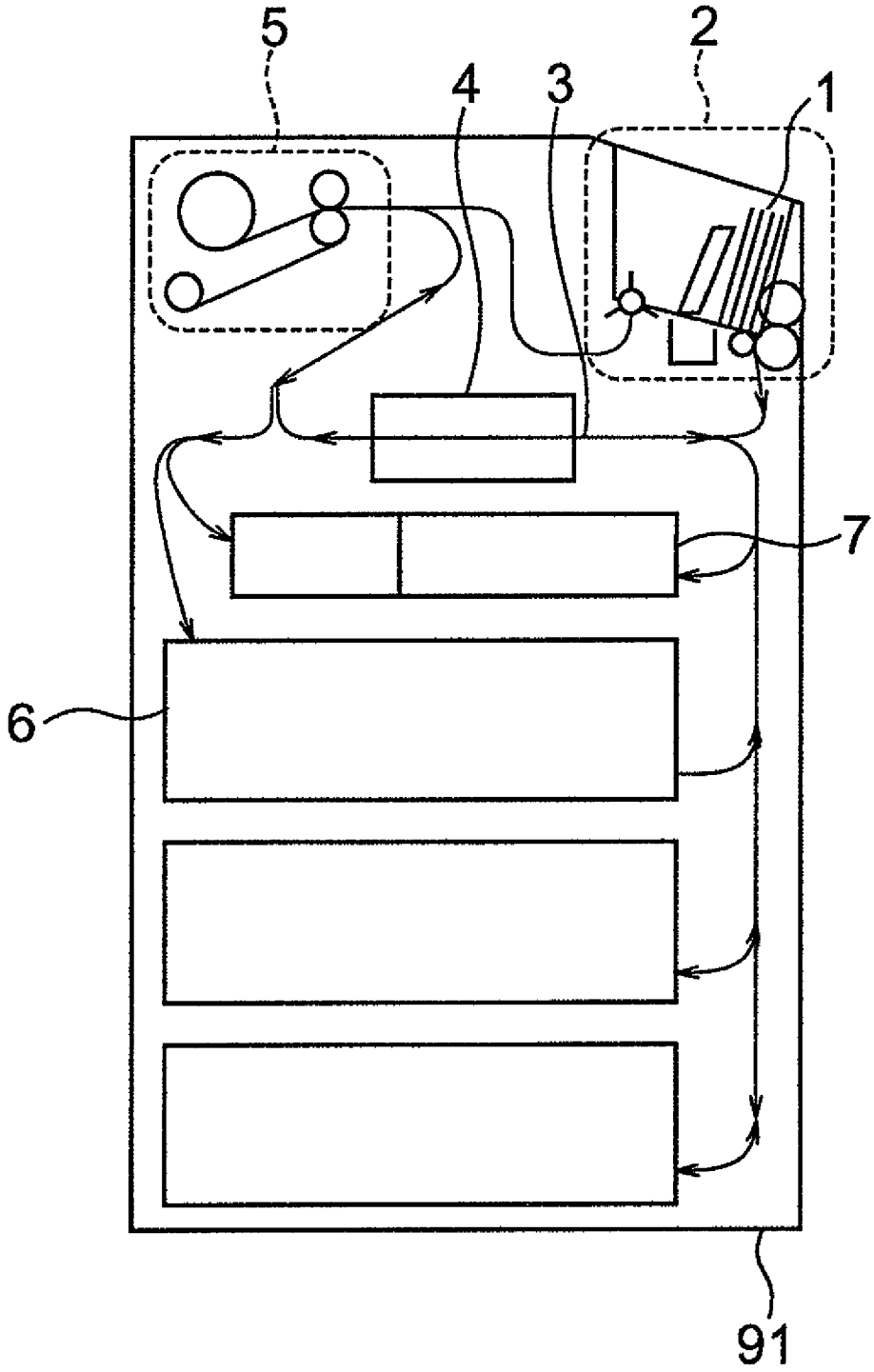
FIG. 2 shows a side view of the automated teller machine shown in FIG. 1.

FIG. 2 is a side view showing a schematic structure of an embodiment of the bill handling unit 91. In FIG. 2, a bill deposit/withdrawal mechanism 2 is comprised of a guide where bills 1 are placed, rollers for feeding the bills 1, rollers for accumulating the bills, and the like. It receives the user-deposited bills 1 by separately receiving them one by one and delivers bills when the user operates to withdraw them. The bill deposit/withdrawal mechanism 2 will be described in detail afterward.

The individual bills 1 separated by the bill deposit/withdrawal mechanism 2 are conveyed to a downstream mechanism through a transport path 3, and subjected to discrimination and detection for genuine or not, cleanness and dirtiness, denominations, transport states and the like of the bills by a discriminating device 4. A temporary accumulation mechanism 5 for temporarily accumulating and discharging the deposited bills is mainly comprised of drums and a tape and accumulates the bills by winding the tape around the drums and discharges the bills by rewinding the tape. Circulating boxes 6 are detachable safes for housing bills in accordance with denominations which have been judged to be suitable for payment by the discriminating device 4. A reject box 7 is a detachable safe for housing bills which are judged not suitable for payment by the discriminating device 4.

The bill deposit/withdrawal mechanism 2 configuring a part of the automated teller machine according to an embodiment of the invention is described with reference to FIG. 3.

The bill deposit/withdrawal mechanism 2 is comprised of a bill feeding unit which consists of pickup rollers 22, feed rollers 23 and gate rollers 24, a bill press unit which consists of a front plate 25, a push plate 26 and separation guides 27, 28, and a bill accumulation unit which consists of an impeller 29 and an accumulation guide 30.

Figure 4:
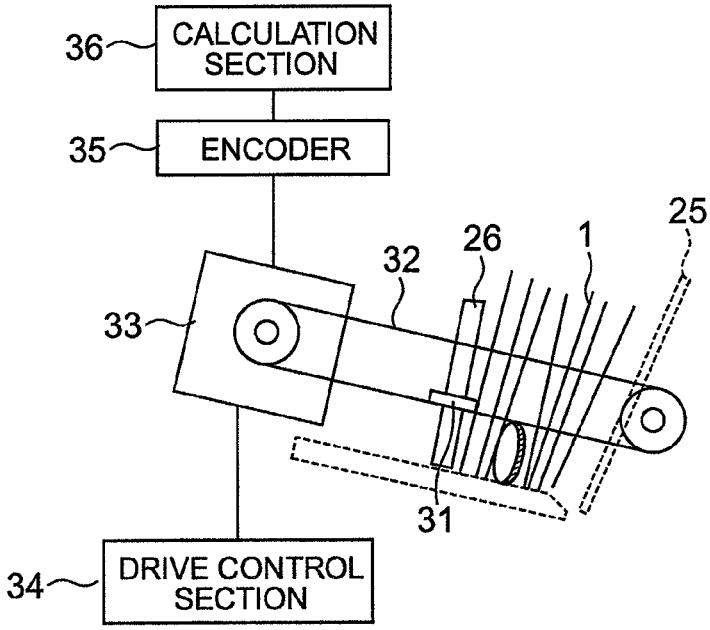
FIG. 4 shows a schematic view of a push plate drive system of the automated teller machine shown in FIG. 1.

The push plate 26 of the bill press unit has its one end on this side only shown in FIG. 4, but its both ends are attached to driving timing belts 32 via connecting sections 31. The timing belts 32 are driven by a motor 33 and guided to move along a track determined by a guide roller and a rail guide (not shown in FIG. 4) which are mounted on the connecting sections. The motor 33 is controlled by a drive control section 34 for the motor and its rotations are detected by an encoder 35. Data of the rotations detected by the encoder 35 is sent to a calculation section 36.

Figure 3:
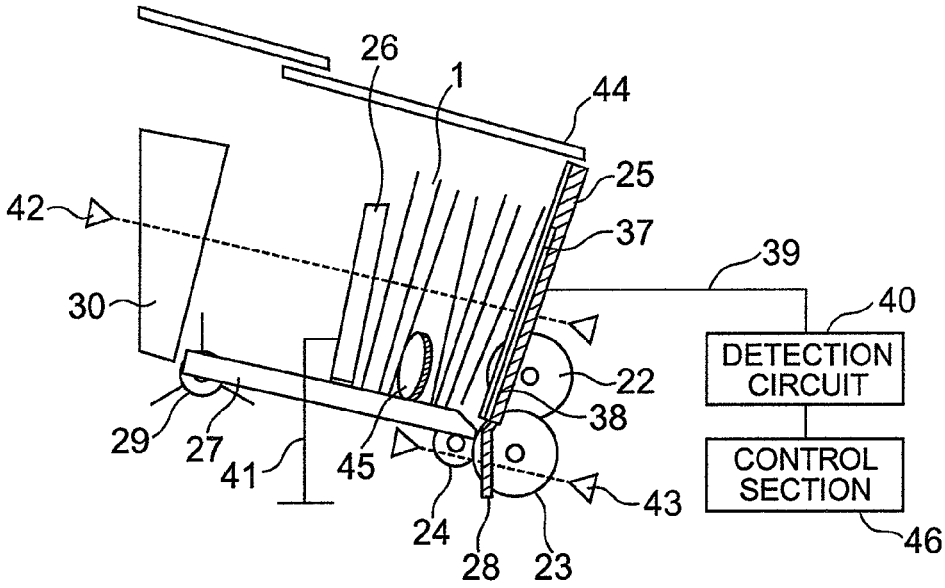
FIG. 3 shows a bill deposit/withdrawal mechanism configuring a part of the automated teller machine shown in FIG. 1.
Figure 5:
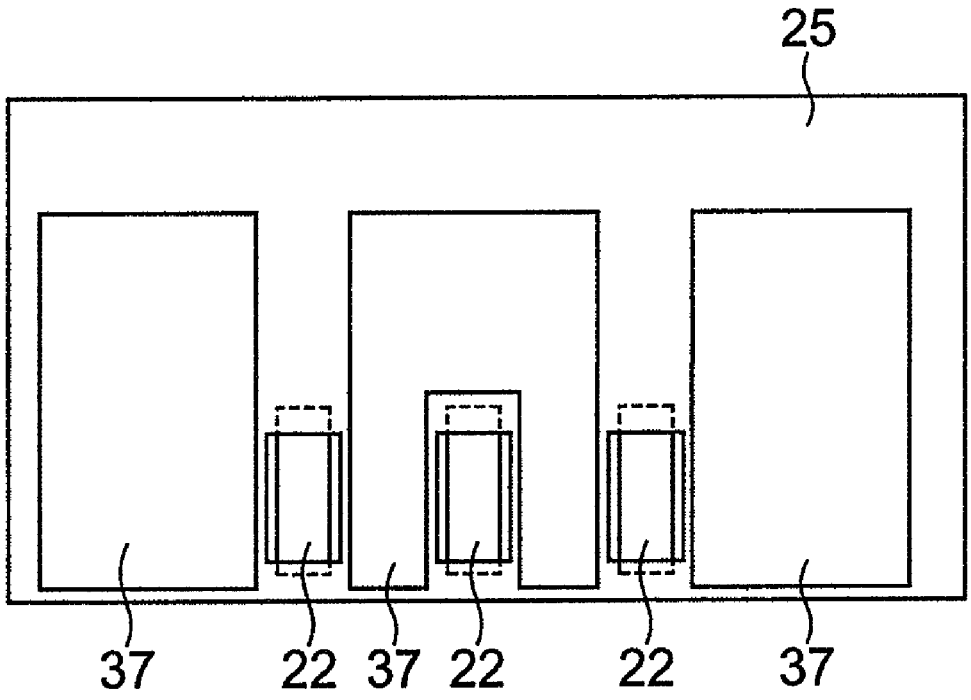
FIG. 5 shows a schematic view of the structure of a front plate of the automated teller machine shown in FIG. 1.

The front plate 25 has on its surface three copper foil antennas 37 and a cover 38 for covering them as shown in FIG. 3 and FIG. 5. The antennas 37 are connected to a detecting circuit 40 for detecting a foreign object through a signal line 39.

The push plate 26 is partially or entirely formed of a conductive material, and its conductive part is grounded through a signal line 41.

As other component elements, a bill presence sensor 42 for detecting the presence or not of the deposited bills, a separation sensor 43 for detecting the front and rear ends of the separated bill, and a mechanism for opening and closing a shutter 44 for the bill deposit/withdrawal port are mounted.

The deposit operation of the bill deposit/withdrawal mechanism 2 is described below.

When a user deposits the bills 1 into the space in the bill deposit/withdrawal port, the shutter 44 is closed. Then, the push plate 26 is driven to push the deposited bills 1 toward the pickup rollers 22. When the pressure for pushing against the pickup rollers 22 is detected by an unshown detection unit and becomes a prescribed value, a stop signal is sent to the drive control section 34 to stop the motor 33, and the push plate 26 is stopped. Then, a control section 46 operates to judge whether or not a foreign object such as a coin 45 or a paper clip is included in the deposited bills 1 by the foreign object detecting circuit 40.

If a foreign object is not included, the pickup rollers 22 and the feed rollers 23 are driven by an unshown drive source, and the bills are separated and fed one at a time by the gate rollers 24. If the deposited bills 1 include a foreign object such as a coin or a paper clip, a signal indicating the inclusion of the foreign object is transmitted to the control section 46, and the control section 46 generates a control signal for returning the push plate 26 to perform the reverse drive of the motor 33, thereby returning the push plate 26 to the prescribed initial position. Then, the shutter 44 is opened, and guide information about the inclusion of a foreign object and a request for removal of it is shown on the display operation section 93 and also announced to the user by an unshown audio unit.

The detecting circuit 40 is described in detail below.

Figure 6:
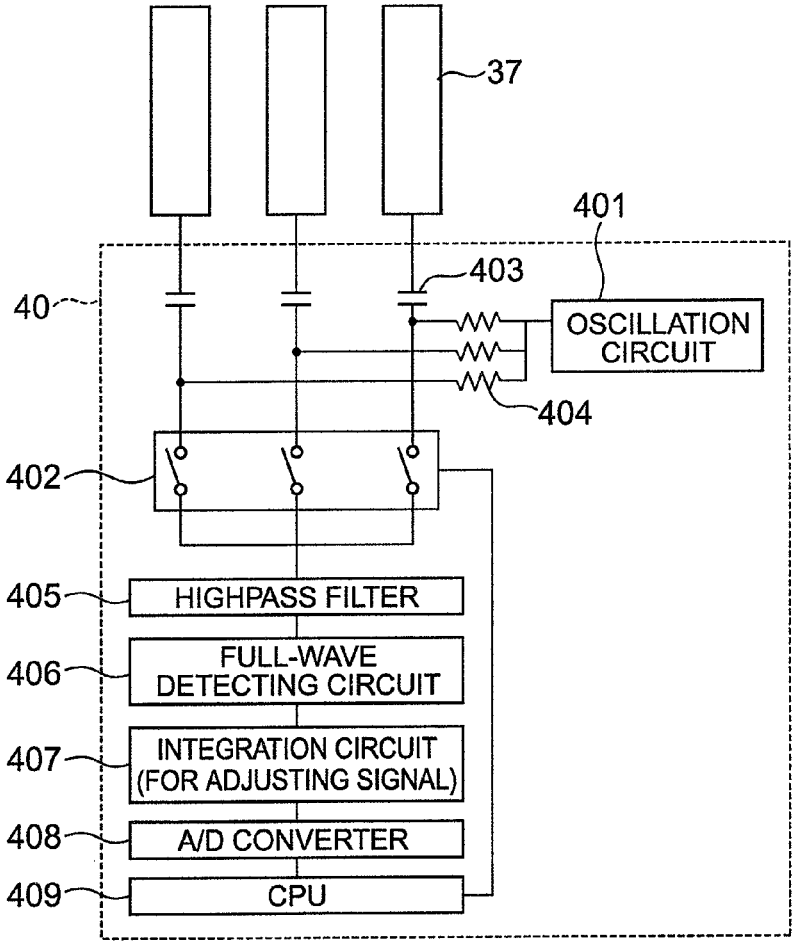
FIG. 6 shows a foreign object detecting circuit of the automated teller machine shown in FIG. 1.

As shown in FIG. 6, the detecting circuit 40 is comprised of an oscillation circuit 401 for applying a high-frequency sine wave to the antennas 37, change-over switches 402 for sequentially switching the connection between the antennas 37 and subsequent signal processing circuits, capacitors 403 which are connected between the antennas 37 and the oscillation circuit 401 and remove a DC component of a signal, resistors 404 which are connected between the oscillation circuit 401 and the antennas 37, a highpass filter 405 which is one of the signal processing circuits to allow passage of only a signal having a prescribed frequency or higher, a full-wave detecting circuit 406 which is one of the signal processing circuits to obtain an absolute value of a signal and to rectify the signal, an integration circuit 407 (for signal adjustment) which is one of the signal processing circuits to performing gain adjustment and offset adjustment, an A/D converter 408 which is one of the signal processing circuits to convert an analog signal to a digital signal, and a CPU 409 which sends a channel selection signal to the change-over switches 402, receives an output signal from the A/D converter 408 and judges as a judging unit the presence or not of a foreign object based on the output signal.

The copper foil is used for the antennas 37 in this embodiment, but another transparent material such as ITO (indium tin oxide) or NESA (tin oxide) may be used if it is conductive.

In this embodiment, the oscillation circuit 401 which generates a high-frequency sine wave is connected to the copper foils 37 via the resistors 404 and the capacitors 403, but the capacitors 403 may be omitted.

When there are plural antennas as detection elements as in this embodiment, the change-over switches 402 perform an change-over operation between the plural antennas and the subsequent signal processing circuits including the highpass filter 405, the full-wave detecting circuit 406, the integration circuit 407 and the A/D converter 408 according to a control signal from the CPU 409 so not to connect two or more antennas to the subsequent signal processing circuits. Thus, the subsequent signal processing circuits comprising the highpass filter 405, the full-wave detecting circuit 406, the integration circuit 407 and the A/D converter 408 can be integrated into one, so that the number of parts can be decreased, an approach position input device can be miniaturized and the cost can be reduced. The change-over switches 402 are, for example, analog switches but may be another type if the same effects can be obtained.

In a case where the antennas 37 are mounted away from the capacitors 403, it is desirable that they are connected through a shielded line so that adverse effects of external noise can be eliminated.

The highpass filter 405 which is disposed to remove low-frequency noise has its input side connected to the change-over switches 402 and its output side connected to the full-wave detecting circuit 406. In the embodiment of the invention, the low-frequency noise is removed by the highpass filter 405 because it is sufficient by sending the signal proximity of the oscillation frequency of the oscillation circuit 401 to the full-wave detecting circuit 406.

The full-wave detecting circuit 406 has its input side connected to the highpass filter 405 and its output side connected to the integration circuit 407. The signal from the highpass filter 405 is a sine wave which vibrates in a plus range and a minus range. To input a signal to the A/D converter 408, the full-wave detecting circuit 406 converts the signal in the minus range into an absolute value in the plus range. The full-wave detecting circuit 406 also rectifies the signal.

The integration circuit 407 has its input side connected to the full-wave detecting circuit 406 and its output side connected to the A/D converter 408 and performs the offset adjustment and gain adjustment of the signal from the full-wave detecting circuit 406. The offset adjustment and gain adjustment are performed to adjust the sensitivity of the virtual capacitor in the bill deposit/withdrawal port, thereby setting to have high detection sensitivity.

The A/D converter 408 has its input side connected to the integration circuit 407 and its output side connected to the CPU 409 and converts an analog signal from the integration circuit 407 into a digital signal.

The CPU 409 is connected to the change-over switch 402 and the A/D converter 408, sends a selection signal for the antenna 37 to the change-over switch 402, and performs calculation processing to detect a foreign object on the basis of the signal from the A/D converter 408.

Figure 7:
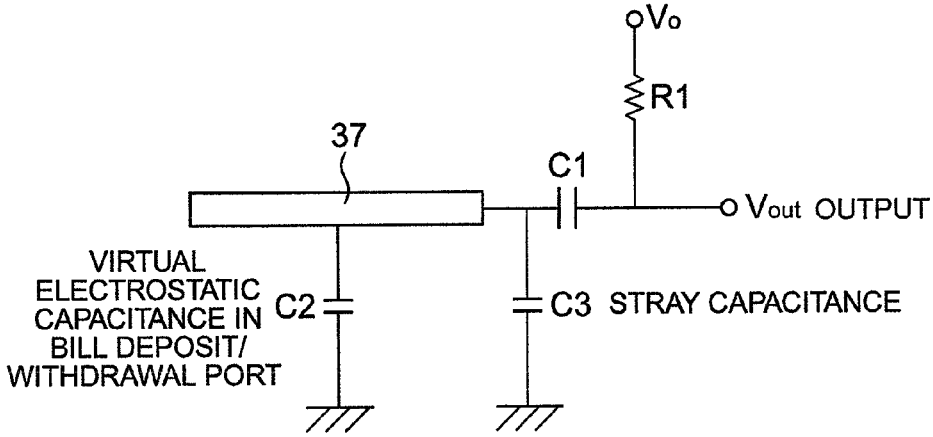
FIG. 7 is a schematic view of a detecting circuit of one antenna of the automated teller machine shown in FIG. 1.

The foreign object detection principle is described with reference to the circuit shown in FIG. 7. FIG. 7 is a schematic view showing the detecting circuit of one of the antennas 37, and the other antennas also have the same detecting circuit structure. In FIG. 7, the change-over switch 402 and the subsequent circuits are omitted.

Figure 8:
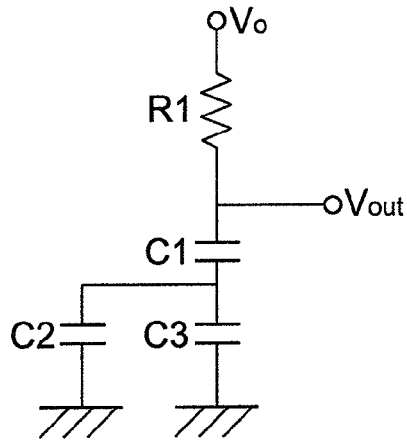
FIG. 8 shows an equivalent circuit of the detecting circuit of the antenna shown in FIG. 7.

In FIG. 7, Vo denotes an AC voltage of the sine wave applied by the oscillation circuit 401, Vout denotes an output signal voltage connected to an unshown change-over switch 402, C1 denotes the electrostatic capacitance of the capacitor 403, and R1 denotes the resistance of the resistor 404. Since the push plate 26 is grounded as described above, the push plate 26 and the antennas 37 mounted on the front plate 25 within the bill deposit port configure a virtual capacitor therebetween, C2 denotes the electrostatic capacitance of the virtual capacitor, and C3 denotes the stray capacitance of the antenna 37. FIG. 8 shows a circuit equivalent to the circuit having the antenna 37 shown in FIG. 7.

Figure 9:
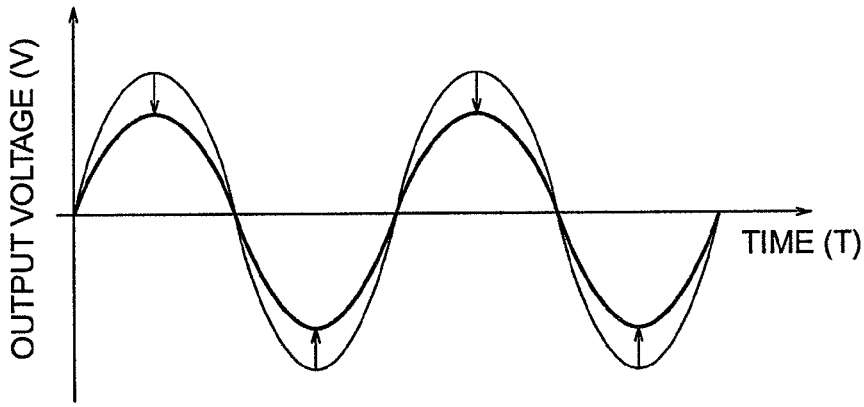
FIG. 9 shows a change in the output voltage of the circuit shown in FIG. 7 and FIG. 8.

The position where the push plate 26 stops is variable depending on the number of deposited bills, so that the electrostatic capacitance C2 of the virtual capacitor changes, and when an AC voltage is applied to the antenna 37, the output voltage Vout in the circuit of FIG. 8 changes as shown in FIG. 9. In other words, it is easily apparent from the structure shown in FIG. 3 and a basic formula for the capacitor that when the distance between the push plate 26 and the front plate 25 is long (corresponding to the case where the number of bills deposited into the bill deposit/withdrawal port is many) in this embodiment, the distance between the capacitor electrodes becomes long, and a value of the electrostatic capacitance C2 of the virtual capacitor becomes small, but when the distance between the push plate 26 and the front plate 25 is short (corresponding to the case where the number of bills deposited into the bill deposit/withdrawal port is small), a value of the electrostatic capacitance C2 becomes large. Therefore, the output signal Vout is variable depending on a change in the electrostatic capacitance C2 within the bill deposit/withdrawal port due to a difference of the distance between the push plate 26 and the front plate 25 (corresponding to the difference of the number of bills deposited into the bill deposit/withdrawal port).

The output signal Vout generated depending on the difference of the distance between the push plate 26 and the front plate 25 in this embodiment is relevant to the rotation signal from the encoder 35 which detects the rotations of the motor for driving the push plate 26, and the output signal corresponding to the distance between the front plate 25 and the push plate 26 is used as a reference signal for calibration.

Calibration operation is described below. The control section 46 operates for a bill separation operation to move the push plate 26 toward the front plate 25 at prescribed time intervals, detects the rotation signal and the output voltage Vout at the same time, stores them in the memory within the control section 46, and determines it as a reference signal until the next calibration operation. By comparing with the reference signal, it is possible to distinguish whether the difference from the output voltage detected at the time of the actual bill separation operation is generated due to the number of deposited bills or the inclusion of a foreign object.

There is a little difference between the output signal with no bill within the bill deposit/withdrawal port and the output voltage with bills actually present, but the difference is small when the bills are normal. Therefore, the output signal with no bill within the bill deposit/withdrawal port may be determined as the reference signal. If the above difference becomes large, the output voltage when the bills are deposited may be measured to determine a correction coefficient in advance, and the output signal detected at the time of calibration is multiplied by the correction coefficient to obtain a value which is determined as the reference signal.

Figure 10:
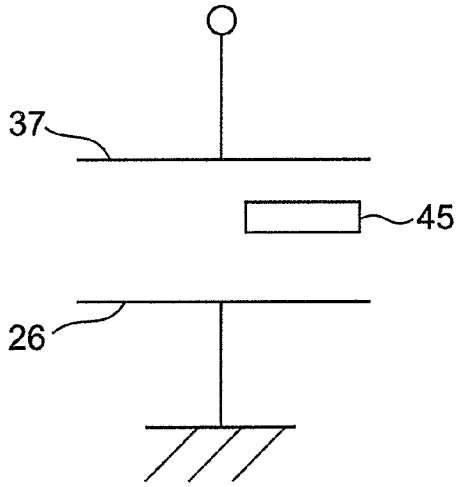
FIG. 10 shows an equivalent circuit of a virtual capacitor in a case where a foreign object is included.

Inclusion of a foreign object such as a coin or a paper clip into the bills deposited in the bill deposit/withdrawal port is described below. An equivalent circuit of the virtual capacitor C2 of this case is shown in FIG. 10. As shown in FIG. 10, the virtual capacitor capacitance C2 formed within the space of the bill deposit/withdrawal port changes to become C2B if there is a foreign object within it, and the output voltage is also changed to become VoutB which has a value different from the output voltage Vout of a case where there is no foreign object.

For example, in a case where 50 bills are deposited into the space of the bill deposit/withdrawal port, the actually measured output voltage becomes V50B if a foreign object is included in the bills when a voltage at a distance corresponding to 50 bills of the reference signal previously stored in the memory is determined to be V50. The measured output voltage V50B and the reference signal V50 are compared, and if the difference dV50 is equal to or larger than a prescribed value, it is judged that there is a foreign object. The control section 46 performs the above operation every time bills are deposited into the space of the bill deposit/withdrawal port.

Figure 11:
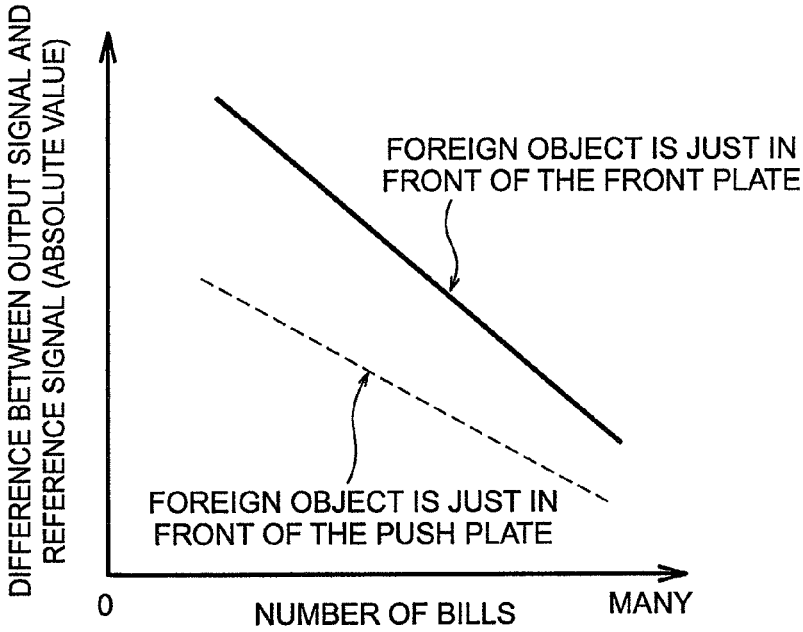
FIG. 11 shows a tendency of a difference (voltage difference) between an output signal (output voltage) and a reference signal (reference voltage) of the circuit shown in FIG. 7 and FIG. 8 in a case where a foreign object is included.

Even when a foreign object is included in the deposited bills, a voltage difference is variable depending on where the foreign object is present. In FIG. 11, the horizontal axis represents the number of bills, and the vertical axis represents the difference between the output signal (output voltage) and the reference signal (reference voltage), thereby indicating a tendency of the difference when a foreign object such as a coin is included in this embodiment. As shown in FIG. 11, when the number of bills increases, the difference between the output signal and the reference signal becomes small, but the difference from the reference signal becomes larger as the foreign object is closer to the front plate 25, and the difference from the reference signal becomes smaller as the foreign object is closer to the push plate 26. In either case, there is no problem when the difference from the reference signal is considerably larger than the voltage difference due to the noise resulting from disturbances in all types of operating states, but there is a problem that the detection performance is lowered when the voltage difference due to the noise and the voltage difference due to the presence of the foreign object are close mutually.

Figure 12:
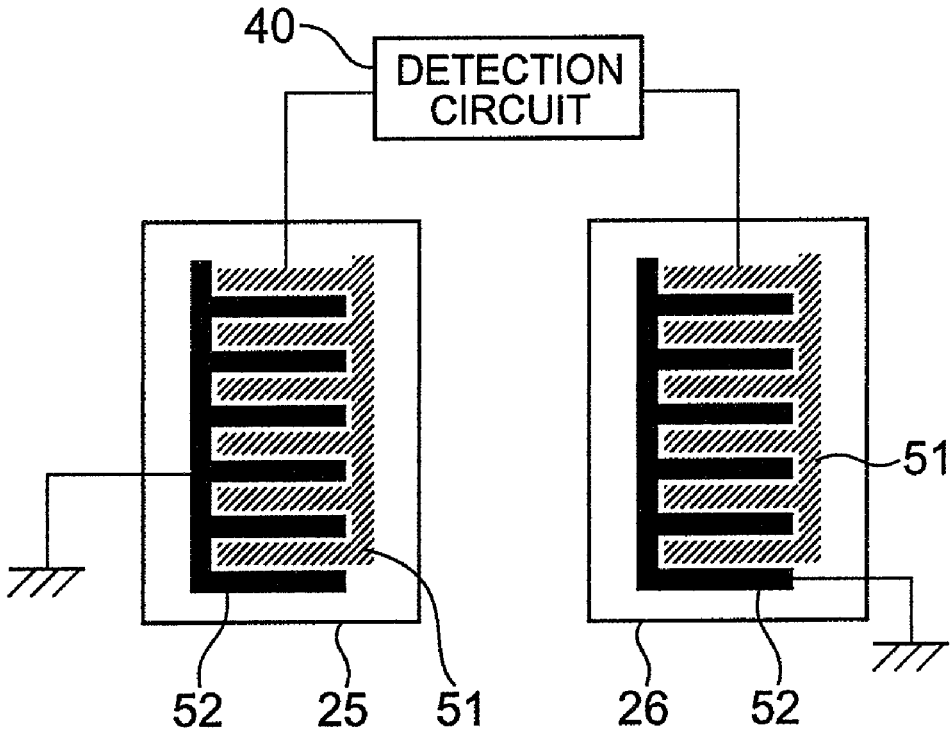
FIG. 12 shows another embodiment of the antennas according to the invention.

FIG. 12 shows an embodiment of dealing with the above problem. In this embodiment, both the front plate 25 and the push plate 26 are provided with antennas A 51 connected to the detecting circuit 40 and antennas B 52 grounded. By configuring in this way, the detected signal becomes a signal which is a total of a signal from the antenna disposed on the side of the front plate 25 shown in FIG. 3 and a signal from the antenna disposed on the side of the push plate 26, so that the voltage difference due to the presence of a foreign object can be doubled approximately. Thus, the foreign object can be detected surely.

The number of antennas disposed in the embodiment was determined to be plural as an example. But, the number of antennas is appropriately determined depending on the size, material or the like of the object to be detected and not limited particularly. It is a matter of design. The number of antennas may be one. In FIG. 3, the push plate is wholly made of a conductive material but may be configured to have a conductive surface on the side opposite to the front plate 25.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A foreign object detection apparatus, comprising:

at least one pair of first and second members which are members configuring a space, in which bills to be processed are deposited, and disposed to face each other to push and sandwich the bills therebetween;

a first electrode member which is made of a conductive material disposed on at least a part of the first member to face the space;

a second electrode member which is made of a conductive material disposed on at least a part of the second member to face the space;

a ground unit which grounds the second electrode member;

a voltage applying unit which applies a voltage to the first electrode member;

a measuring unit which measures a voltage generated according to electrostatic capacitance of a virtual capacitor which is comprised of the first and second electrode members; and a judging unit which judges whether a foreign object is present according to a difference between a prescribed reference signal and a changed output voltage from the measuring unit depending on a change in electrostatic capacitance of the virtual capacitor.

2. A foreign object detection apparatus, comprising:

at least one pair of first and second members which are members configuring a space, in which bills to be processed are deposited, and disposed to face each other to push and sandwich the bills therebetween;

a first electrode member which is made of a conductive material disposed on at least a part of the first member to face the space;

a second electrode member which is made of a conductive material disposed on at least a part of the second member to face the space;

a ground unit which grounds the second electrode member;

a voltage applying unit which applies a voltage to the first electrode member;

a measuring unit which measures a voltage generated according to electrostatic capacitance of a virtual capacitor which is comprised of the first and second electrode members;

a distance calculation unit which calculates a distance between the first member and the second member;

a storage unit which stores a distance determined by the distance calculation unit and a voltage detected by the measuring unit in correspondence with the distance and determines as a reference signal; and a judging unit which judges whether a foreign object is present according to a difference between a prescribed reference signal and an output voltage changed from the measuring unit depending on a change in electrostatic capacitance of the virtual capacitor.

3. A foreign object detection apparatus, comprising:

at least one pair of first and second members which are members configuring a space, in which bills to be processed are deposited, and disposed to face each other to push and sandwich the bills therebetween;

a first electrode member which is made of a conductive material disposed on at least a part of the first and second members to face the space;

a second electrode member which is made of a conductive material disposed on at least a part of the first and second members to face the space;

a ground unit which grounds the second electrode member;

a voltage applying unit which applies a voltage to the first electrode member;

a measuring unit which measures a voltage generated according to electrostatic capacitance of a virtual capacitor which is comprised of the first and second electrode members; and a judging unit which judges whether a foreign object is present according to a difference between a prescribed reference signal and a changed output voltage from the measuring unit depending on a change in electrostatic capacitance of the virtual capacitor.

4. A foreign object detection apparatus, comprising:

at least one pair of first and second members which are members configuring a space, in which bills to be processed are deposited, and disposed to face each other to push and sandwich the bills therebetween;

a first electrode member which is made of a conductive material disposed on at least a part of the first and second members to face the space;

a second electrode member which is made of a conductive material disposed on at least a part of the first and second members to face the space;

a ground unit which grounds the second electrode member;

a voltage applying unit which applies a voltage to the first electrode member;

a measuring unit which measures a voltage generated according to electrostatic capacitance of a virtual capacitor which is comprised of the first and second electrode members;

a distance calculation unit which calculates a distance between the first member and the second member;

a storage unit which stores a distance determined by the distance calculation unit and a voltage detected by the measuring unit in correspondence with the distance and determines as a reference signal; and a judging unit which judges whether a foreign object is present according to a difference between a prescribed reference signal and a changed output voltage from the measuring unit depending on a change in electrostatic capacitance of the virtual capacitor.

5. The foreign object detection apparatus according to claim 1, wherein the voltage applying unit includes an oscillation circuit which generates a high-frequency sine wave.

6. The foreign object detection apparatus according to claim 1, wherein the foreign object detection apparatus is for a bill processing device, and the space in which the bills to be processed are deposited is a space of the bill processing device in which bills are deposited.

* * * * *